US009676542B1

(12) United States Patent
Tan

(10) Patent No.: US 9,676,542 B1
(45) Date of Patent: Jun. 13, 2017

(54) BAG CONTAINER DISPENSER AND DISPENSER RACK

(71) Applicant: Jessica Tan, Harahan, LA (US)

(72) Inventor: Jessica Tan, Harahan, LA (US)

( * ) Notice: Subject to any disclaimer, the term of this patent is extended or adjusted under 35 U.S.C. 154(b) by 0 days.

(21) Appl. No.: 14/873,224

(22) Filed: Oct. 2, 2015

(51) Int. Cl.

| | |
|---|---|
| ***A47K 10/24*** | (2006.01) |
| ***B65H 1/00*** | (2006.01) |
| ***B65D 83/08*** | (2006.01) |
| ***B65D 25/24*** | (2006.01) |
| ***B65D 33/16*** | (2006.01) |
| ***B65D 85/62*** | (2006.01) |

(52) U.S. Cl.
CPC ..... *B65D 83/0805* (2013.01); *B65D 25/24* (2013.01); *B65D 33/16* (2013.01); *B65D 85/62* (2013.01)

(58) Field of Classification Search
CPC ..... A47F 9/042; A47F 1/121; A47F 13/085; A47F 1/04; B65D 83/08
USPC ..... 221/1, 45, 85, 47; 211/85.5, 85.515, 211/85.15, 12, 106
See application file for complete search history.

(56) References Cited

U.S. PATENT DOCUMENTS 2,554,232 A 5/1951 Young
2,656,916 A * 10/1953 Henderson ..... B65D 83/0894 221/50
3,514,015 A * 5/1970 Hein ..... A47F 1/04 211/51
3,782,073 A * 1/1974 Musser ..... B65B 43/26 206/554
3,935,838 A * 2/1976 Johnson ..... A01K 5/0241 119/54
4,058,235 A * 11/1977 Cassia ..... A47K 10/42 131/238
4,216,863 A 8/1980 Seymour-Smith
4,454,974 A * 6/1984 Cooke ..... A47K 10/40 225/106
4,512,476 A 4/1985 Herrington
4,722,372 A * 2/1988 Hoffman ..... A47K 5/1209 137/562

(Continued)

FOREIGN PATENT DOCUMENTS

DE 102006040920 A1 * 3/2008 ..... A47F 13/085
FR 2873663 A1 * 2/2006 ..... A47F 9/042

(Continued)

*Primary Examiner* — Rakesh Kumar
(74) *Attorney, Agent, or Firm* — David A. Belasco; Belasco Jacobs & Townsley, LLP

(57) ABSTRACT

A bag container dispenser includes a bag container. The container is formed of resilient material and has a bottom, a top, first and second sides, a front, a back and a removable access panel. The access panel has a top segment that includes a portion of the top and a connected front segment. The front segment has a height that extends from the bottom to the top. Stacked bags are sized and shaped to fit within the bag container. Each of the bags has a front wall, a back wall, an open top and a closure mechanism. The bags are dispensable from the container through an opening provided by removal of the access panel which may have a removable cover. A dispenser rack has a horizontal platform sized and shaped to support the bag container. Peripheral guards extend upward from the platform and constrain movement of the container during dispensing.

12 Claims, 11 Drawing Sheets

(56) References Cited

U.S. PATENT DOCUMENTS 4,805,800 A * 2/1989 Nocek ..... B65D 83/0894 206/554
4,813,535 A 3/1989 Radocha
5,310,057 A 5/1994 Caldwell
5,467,956 A * 11/1995 Herr ..... A47K 10/3836 211/16
5,509,570 A 4/1996 DeMatteis
5,529,221 A * 6/1996 Roy ..... G01F 11/24 222/181.2
5,857,586 A 1/1999 Scherr
5,862,944 A 1/1999 Scherr
6,431,375 B2 8/2002 Spencer
6,655,546 B1 * 12/2003 Bolton ..... B65D 83/0847 206/554
6,729,483 B1 * 5/2004 Nguyen ..... A47F 9/042 206/554
6,761,269 B2 7/2004 Hamming
6,772,909 B2 8/2004 Bateman
7,275,657 B2 10/2007 Geyer
7,353,569 B2 * 4/2008 Chen ..... G06F 1/1601 16/340
7,481,393 B2 * 1/2009 Trinko ..... A47F 9/042 206/409
7,617,941 B2 11/2009 Colin
7,624,881 B2 * 12/2009 Wilfong, Jr. ..... A47F 13/085 211/59.1
8,381,921 B2 * 2/2013 Tan ..... A47F 9/042 211/12
8,534,462 B1 * 9/2013 Tan ..... B65D 83/0847 206/494
8,567,618 B2 * 10/2013 Tan ..... A47F 9/042 211/85.15
8,672,214 B2 3/2014 Manaige
2001/0023873 A1 * 9/2001 Wile ..... A47F 5/01 221/26
2004/0226961 A1 * 11/2004 Mehus ..... B01F 1/0027 222/77
2007/0181594 A1 * 8/2007 Thompson ..... A47K 10/40 221/190
2009/0212063 A1 * 8/2009 Cohen ..... A47K 10/421 221/45
2009/0289019 A1 * 11/2009 Alvarado ..... A47F 13/085 211/85.15
2012/0279981 A1 * 11/2012 Thomas ..... B65D 83/0805 221/1
2013/0153593 A1 * 6/2013 Silagy ..... B65D 83/0817 221/1
2013/0270292 A1 * 10/2013 Sporre Thorburn ... A47K 10/18 221/283
2013/0284756 A1 * 10/2013 Springer ..... B65D 83/08 221/34
2014/0021215 A1 * 1/2014 Tran ..... A47K 10/42 221/45
2014/0166715 A1 * 6/2014 Tan ..... B65H 35/10 225/46
2015/0076169 A1 * 3/2015 Tan ..... A47F 9/042 221/1
2015/0108156 A1 * 4/2015 Tan ..... A47F 13/085 221/26

FOREIGN PATENT DOCUMENTS

GB 2274098 A * 7/1994 ..... A47F 13/085
GB 2309216 A * 7/1997 ..... A47F 13/085
GB 2349144 A * 10/2000 ..... A47F 9/042
GB 2385314 A * 8/2003 ..... A47F 9/042
JP 08215098 A * 8/1996
WO WO 2004007299 A2 * 1/2004 ..... A47F 9/042
WO WO 2013101130 A1 * 7/2013 ..... A47F 9/042

* cited by examiner

BAG CONTAINER DISPENSER AND DISPENSER RACK

FIELD OF INVENTION

This invention relates to the field of dispensing systems for plastic and other film bags and more specifically to dispensers for stacked bags in dispenser containers and dispenser racks for such containers.

BACKGROUND OF THE INVENTION

Sandwiches and similar food items are usually created for customer orders while the customers wait for their meal, often standing in line at the time. For sanitary reasons, these meals are usually delivered in closable film bags. These bags must be maintained in an orderly and sanitary dispensing facility for the food service institution to function safely and efficiently. The present invention addresses the handling of such closable bags in the tight quarters often associated with such establishments. Similar bags are also used by the customer for self-packing bulk items such as candy, cookies and pet food.

It has been found that stacking the bags allows for easy dispensing while helping to keep the bags clean. Toward this end, the present invention provides for sealed dispensing containers with a tear-away panel providing an opening through which the bags are dispensed. In an alternative embodiment the panel has been torn away and the opening is covered with plastic. In still another embodiment, the plastic covering may be removed in stages to keep the remaining bags fresh and clean. The bags could also be stacked in a vertical configuration in a box sized and shaped accordingly. The bags could also be stacked in a sleeve instead of a box. In order to maintain the dispensing container in user convenient locations, various types of rack mountings have been developed for the bag dispenser container that will effectively grip the dispensing container and position it conveniently at a convenient height while being securely mounted to a floor, counter wall or other convenient surface. An adjustable angle support version of the dispenser is also provided.

U.S. Patent Application No. 2012/0279037, published for Thomas et al., discloses systems of reclosable storage bag refills for a dispensing container. The types of bags involved include those in which the bag closure comprises two elements mechanically engaging one another to form the closure element. These are commonly referred to as zippered plastic bags with one trade name being that of Johnson & Son, Inc. Ziplock® bags. These bags are commonly dispensed from a box such which provides an opening at the top and side of the box so that the bags may be dispensed one at a time from a stack. This reference provides an example of a particular box which has been designed to receive a variety of sizes of the zippered plastic bags.

U.S. Pat. No. 4,512,476, issued to Herrington, Jr., is directed to a plastic bag dispenser providing a box like container with rupturable lines extending along a top and an adjacent solid edge which when ruptured provides an opening in the dispenser of the corner of the top and adjacent side to facilitate removal of folded bags. The bags are folded in thirds along parallel fold lines and individually inserted into the box to facilitate the dispensing of one bag at a time while leaving the remaining bags in the stack untouched. When the individual bags are forward the bags may be removed one at a time from the "dispenser" box.

U.S. Pat. No. 4,805,800, issued to Nocek, illustrates to a dispenser for plastic bags wherein the container or box is perforated so as to have an opening at the top and adjacent side for removal of one bag at a time. The bags are stacked within a container and each lead bag has a trailing end connected by a line of weakened resistance to the leading end of the trailing bag so that when the first bag in removed only a slight force against the edges of the containing box causes the bags to separate and individual bags to be dispensed.

U.S. Patent Application No. 2015/00883677, published for Tan, is directed to a bag dispenser rack that incorporates mounting spikes and pivotally mounted support surface to keep the bags in order, while providing for dispensing of individual bags from a pack with the following bag brought conveniently into open configuration for use thereafter.

U.S. Pat. No. 5,509,570, issued to DeMatteis, illustrates a dispenser of plastic bags which provides for the removal of one bag from the stack within the container while the remaining bags are left untouched within the box.

U.S. Pat. No. 7,275,657, issued to Geyer, and U.S. Pat. No. 6,772,909, issued to Bateman, disclose bag dispensers and show methods by which stacked bags are contained within a container yet with a provision for resistance so that one bag may be removed without disturbing the remaining bags in the stack.

U.S. Pat. No. 5,862,944, issued to Sherr, is directed to dispensers for plastic bags and specifically for plastic bags of the reclosable type. Each of these dispensers have an opening at the bottom of the plastic outer container wherein a single plastic bag may be grasped and removed from the enclosed stack so that every single reclosable plastic bag may be dispensed one at a time without disturbing the remaining bags.

It is an objective of the present invention to provide a bag dispensing system that provides deli slider and similar bags that are dispensed from a system that occupies a minimum of floor space in a retail store. It is a further objective to provide a system that does not require roll mounted bags. It is a still further objective of the invention to provide a dispensing system adaptable to a variety of different mountings. It is yet a further objective to provide such a system that provides a visual indication of the need to refill the dispenser. It is still a further objective to provide a dispenser that can accommodate multiple bag sizes. Finally, it is an objective of the present invention to provide a bag dispensing system that is durable, inexpensive, easy to keep clean and simple to use.

While some of the objectives of the present invention are disclosed in the prior art, none of the inventions found include all of the requirements identified.

SUMMARY OF THE INVENTION

The present invention addresses all of the deficiencies of prior art deli slider bag box inventions and satisfies all of the objectives described above.

(1) A bag container dispenser providing the desired features may be constructed from the following components. A bag container is provided. The container is formed of resilient or flexible material and has a bottom, a top, first and second sides, a front and a back. The container has a removable access panel. The access panel includes a top segment and a front segment. The top segment includes a portion of the top and is connected to the front segment. The front segment has a height. The height extends from the bottom to the top. A plurality of stacked bags is provided.

The bags are sized and shaped to fit within the bag container, each of the bags has a front wall, a back wall, an open top and a closure mechanism. The bags are dispensable from the container through an opening provided by removal of the access panel. Upon removal of the access panel from the container, the bags are dispensed singly from the container. Similar bags are also used by customers for self-packing bulk items such as candy, cookies and pet food. The bags may be stacked in a vertical configuration in a container sized and shaped accordingly. The bags may be stacked in a sleeve of flexible material.

(2) In a variant of the invention, a dispenser rack is provided. The rack has a horizontal platform. The platform is sized and shaped to support the bag container. First and second side guards and front and rear guards are provided. The guards extend orthogonally upward from the platform and are adapted to constrain movement of the bag container. The front guard providing an open space adapted to align with the opening. A rack support is provided. The support is attached to a lower surface of the horizontal platform and adapted to maintain the platform at a first pre-determined height and to provide attachment to a surface.

(3) In another variant, the bag container is formed from material selected from the group that includes cardboard, paperboard, plastic, and metal foil.

(4) In still another variant, the removable access panel is attached to the container with a perforation.

(5) In yet another variant, the plurality of stacked bags have a closure mechanism that includes a foldable top flap. The top flat is adapted to close the bag.

(6) In a further variant, the plurality of stacked bags has a closure mechanism that includes a pair of parallel tracks. The tracks are adapted to be pressed together to close the bag.

(7) In still a further variant, the plurality of stacked bags has a closure mechanism that includes a pair of parallel tracks. The tracks are adapted to be pressed together using a sliding clip, the clip is slidably secured to the tracks.

(8) In yet a further variant, at least one of the first and second side guards and front and rear guards is angled toward a center of the platform, adapting the guard to frictionally grip the container.

(9) In another variant of the invention, the dispenser rack is of wire form construction.

(10) In still another variant, the dispenser rack is formed of wood, plastic or metal.

(11) In yet another variant, the rack support is selected from the group that includes floor stands, wall mounts, surface mounts, counter mounts, glue, screws, nails, looping and hooking fasteners (Velcro®).

(12) In a further variant, the rack support includes a tilting mount. The tilting mount is adapted to position the platform at a variety of angles for dispensing bags.

(13) In still a further variant, a flexible closure flap is provided. The flap is sized and shaped to removably close the opening in the container. The opening results from removal of the access panel. The flap is attached along an upper edge of the flap and is affixed to the top so as to hang over the opening, thereby protecting the container from contamination.

(14) In yet a further variant, the flexible closure flap is attached to the container using an attachment mechanism selected from the group comprising glue, adhesive coatings, tape, staples, tacks, and piercings.

(15) In another variant of the invention, a flexible closure portion is provided. The portion is sized and shaped to removably close the opening in the container. The opening results from removal of the access panel. The portion is attached along first and second side edges of the portion. The portion is affixed to sides of the opening. The portion has at least one perforation extending from the first side edge to the second side edge. The perforation permits partial removal of the portion to permit access to a first stacked number of the bags while protecting a remainder of the bags from contamination.

(16) In still another variant, the flexible closure portion is attached to the container using an attachment mechanism selected from the group comprising glue, adhesive coatings, tape, staples, tacks, and piercings.

(17) In yet another variant of the invention, a flexible closure segment is provided. The segment is sized and shaped to removably close the opening in the container. The opening results from removal of the access panel. The segment is attached along first and second side edges of the segment and is affixed to sides of the opening. The segment has at least one perforation extending from a point adjacent a top edge of the segment to a point adjacent a bottom edge of the segment. The perforation has at least one orthogonal cut. The cut extends for a first pre-determined distance on at least one side of the perforation. The cut adapts the perforation to be opened in stages, thereby minimizing contamination of bags dispensed through the opening.

(18) In a further variant, the flexible closure segment is attached to the container using an attachment mechanism selected from the group comprising glue, adhesive coatings, tape, staples, tacks, and piercings.

(19) In still a further variant, the bags are stacked with the closure mechanism located in an alternating pattern so as to minimize irregularity in a thickness of the stacked bags.

(20) In a final variant of the invention, the bags are stacked with the closure mechanism located in an alternating pattern so as to minimize irregularity in a thickness of the stacked bags.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) As illustrated in FIGS. 1, 1A and 12, bag container dispenser 10 providing the desired features may be constructed from the following components. A bag container 14 is provided. The container 14 is formed of resilient 18 or flexible 20 material and has a bottom 22, a top 26, first 30 and second 34 sides, a front 38 and a back 40. The container 14 has a removable access panel 44. The access panel 44 includes a top segment 48 and a front segment 52. The top segment 48 includes a portion 56 of the top 26 and is connected to the front segment 52. The front segment 52 has a height 60. The height 60 extends from the bottom 22 to the top 26. A plurality of stacked bags 64 is provided. The bags 64 are sized and shaped to fit within the bag container 14. As illustrated in FIGS. 4-6, each of the bags 64 has a front wall 68, a back wall 72, an open top 76 and a closure mechanism 80. As illustrated in FIGS. 1, 1A and 3, the bags 64 are dispensable from the container 14 through an opening 84 provided by removal of the access panel 44. Upon removal of the access panel 44 from the container 14, the bags 64 are dispensed singly from the container 14. Similar bags 64 are also used by customers for self-packing bulk items such as candy (not shown), cookies (not shown) and pet food (not shown). The bags 64 may be stacked in a vertical configuration in a container sized and shaped accordingly, as illustrated in FIG. 6A. The bags 64 may be stacked in a sleeve of flexible material 20 as illustrated in FIG. 12.

Figure 1:
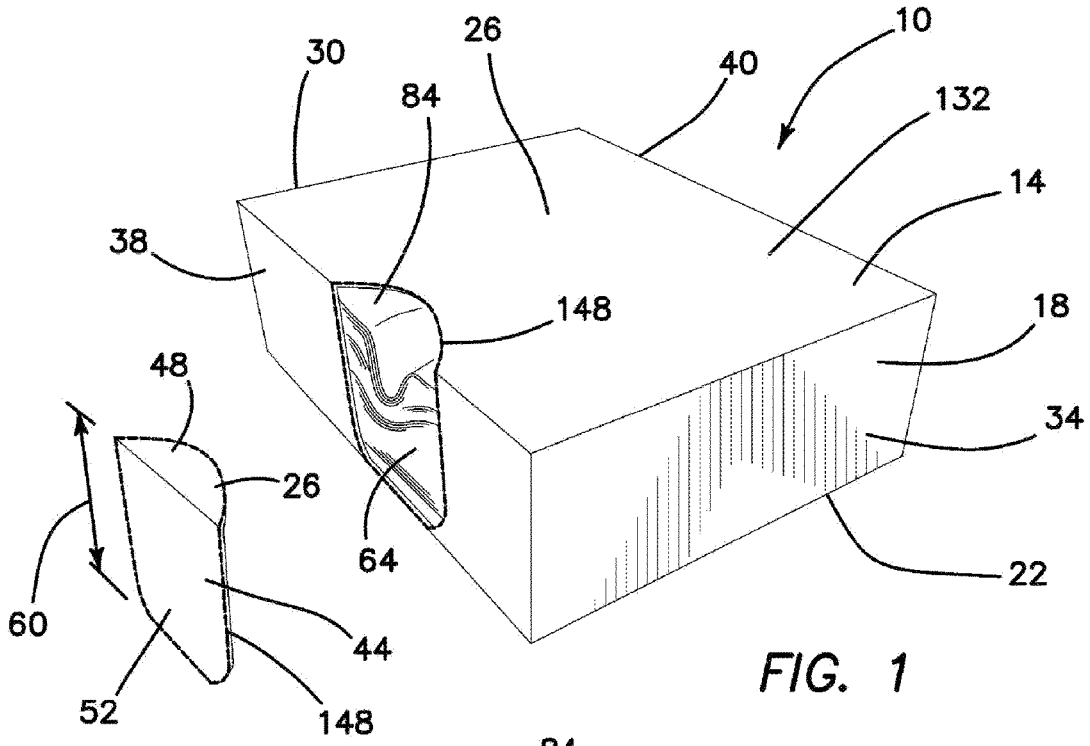
FIG. 1 is a perspective view of the preferred embodiment of the invention illustrating the bag container dispenser with stacked bags inside.

(2) In a variant of the invention, as illustrated in FIGS. 2-3 and 7-12, a dispenser rack 88 is provided. The rack 88 has a horizontal platform 92. The platform 92 is sized and shaped to support the bag container 14. First 96 and second 100 side guards and front 104 and rear 108 guards are provided. The guards 96, 100, 104, 108 extend orthogonally upward from the platform 92 and are adapted to constrain movement of the bag container 14. The front guard 104 providing an open space 112 adapted to align with the opening 84. A rack support 116 is provided. The support 116 is attached to a lower surface 120 of the horizontal platform 92 and adapted to maintain the platform 92 at a first pre-determined height 124 and to provide attachment to a surface 128.

Figure 1A:
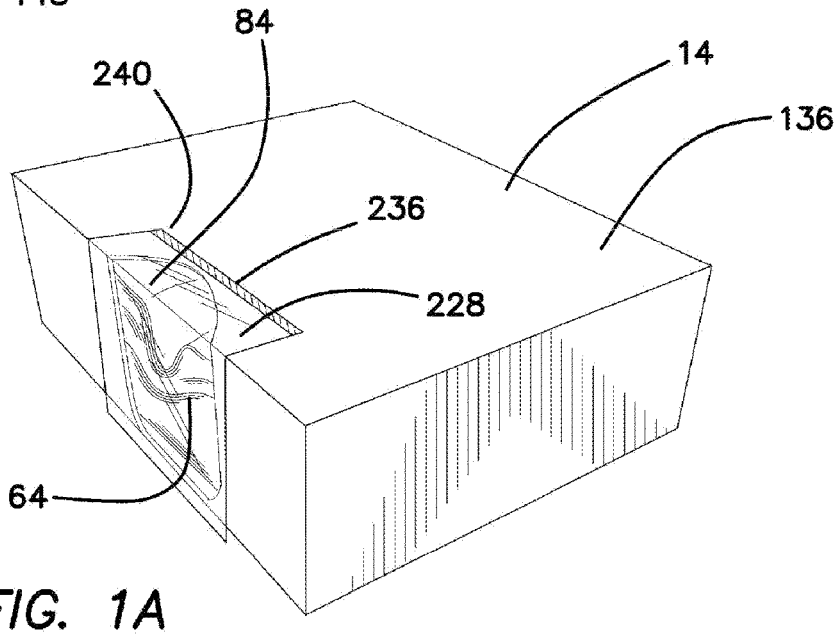
FIG. 1A is a perspective view of the FIG. 1 embodiment illustrating a flexible closure flap attached to the dispenser.
Figure 3:
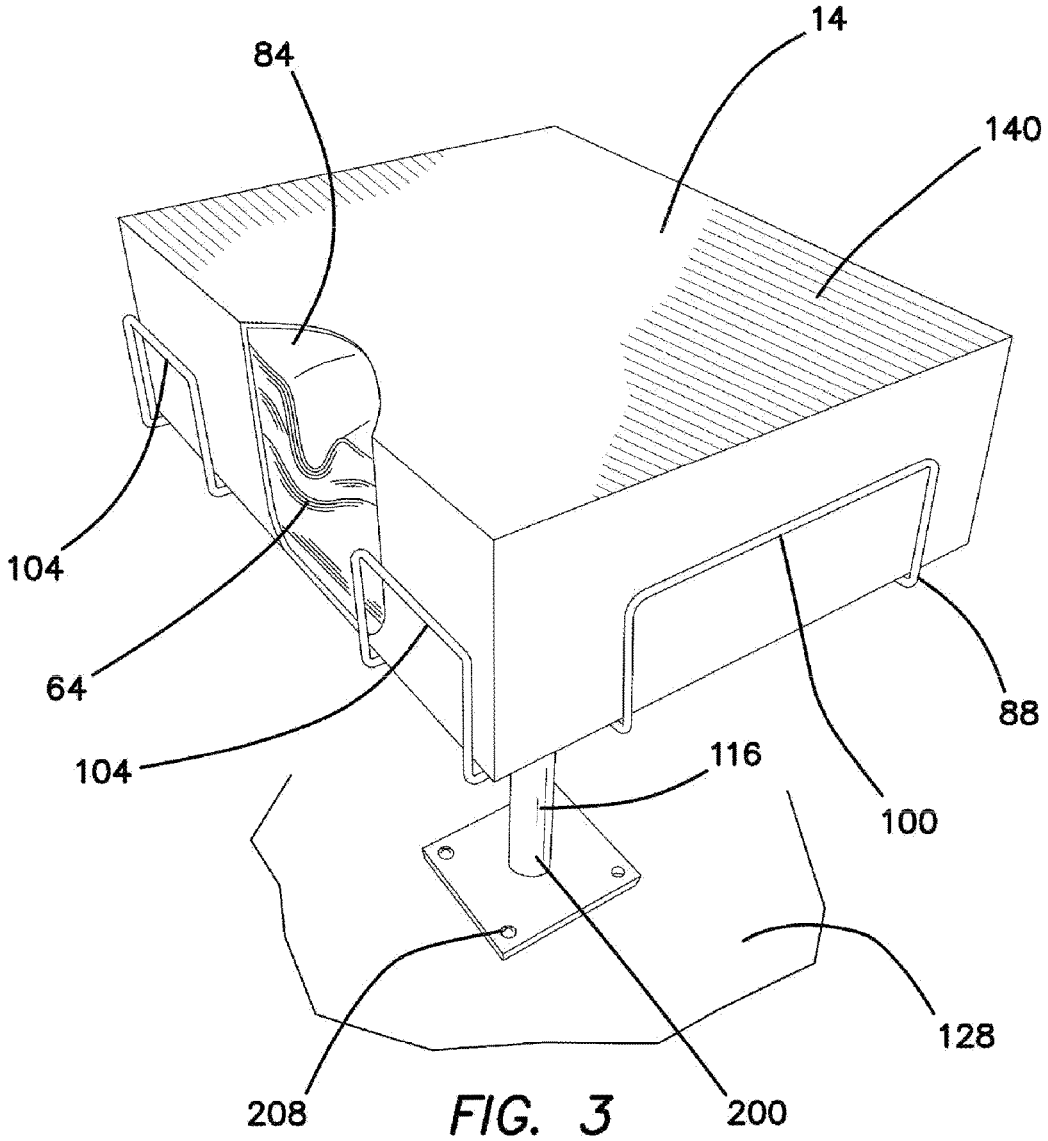
FIG. 3 is a perspective view of the FIG. 1 embodiment installed in the FIG. 2 dispenser rack illustrating a counter mount variant.

(3) In another variant, as illustrated in FIGS. 1, 1A and 3, the bag container 14 is formed from material selected from the group that includes cardboard 132, paperboard 136, plastic 140, and metal foil (not shown).

(4) In still another variant, as illustrated in FIG. 1, the removable access panel 44 is attached to the container 14 with a perforation 148.

Figure 4:
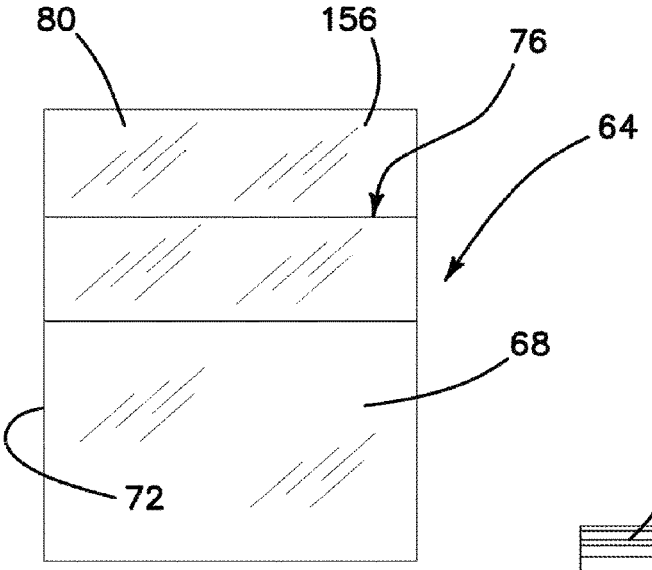
FIG. 4 is a side elevational view of a foldable top flap bag for use with the FIG. 1 embodiment.

(5) In yet another variant, as illustrated in FIG. 4, the plurality of stacked bags 64 have a closure mechanism 80 that includes a foldable top flap 156. The top flat 156 is adapted to close the bag 64.

Figure 5:
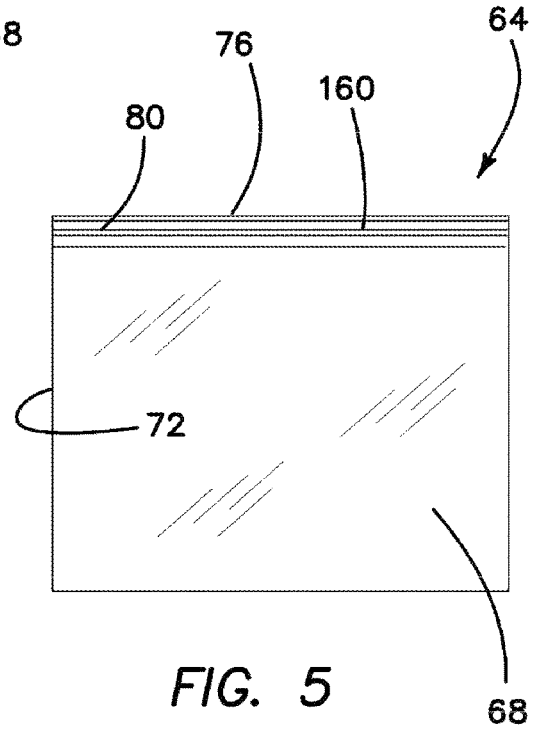
FIG. 5 is a side elevational view of a parallel track closure bag for use with the FIG. 1 embodiment.

(6) In a further variant, as illustrated in FIG. 5, the plurality of stacked bags 64 has a closure mechanism 80 that includes a pair of parallel tracks 160. The tracks 160 are adapted to be pressed together to close the bag 64.

Figure 6:
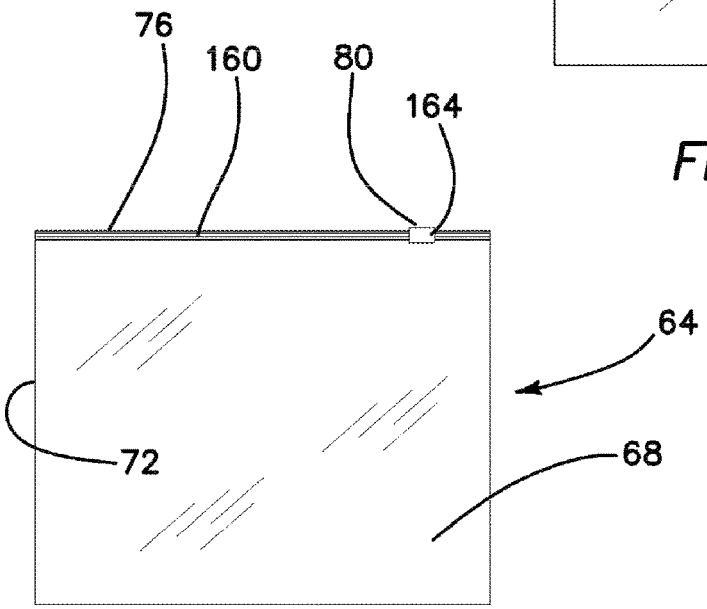
FIG. 6 is a side elevational view of a parallel track with sliding clip closure bag for use with the FIG. 1 embodiment.

(7) In still a further variant, as illustrated in FIG. 6, the plurality of stacked bags 64 has a closure mechanism 80 that includes a pair of parallel tracks 160. The tracks are adapted to be pressed together using a sliding clip 164, the clip 164 is slidably secured to the tracks 160.

Figure 2:
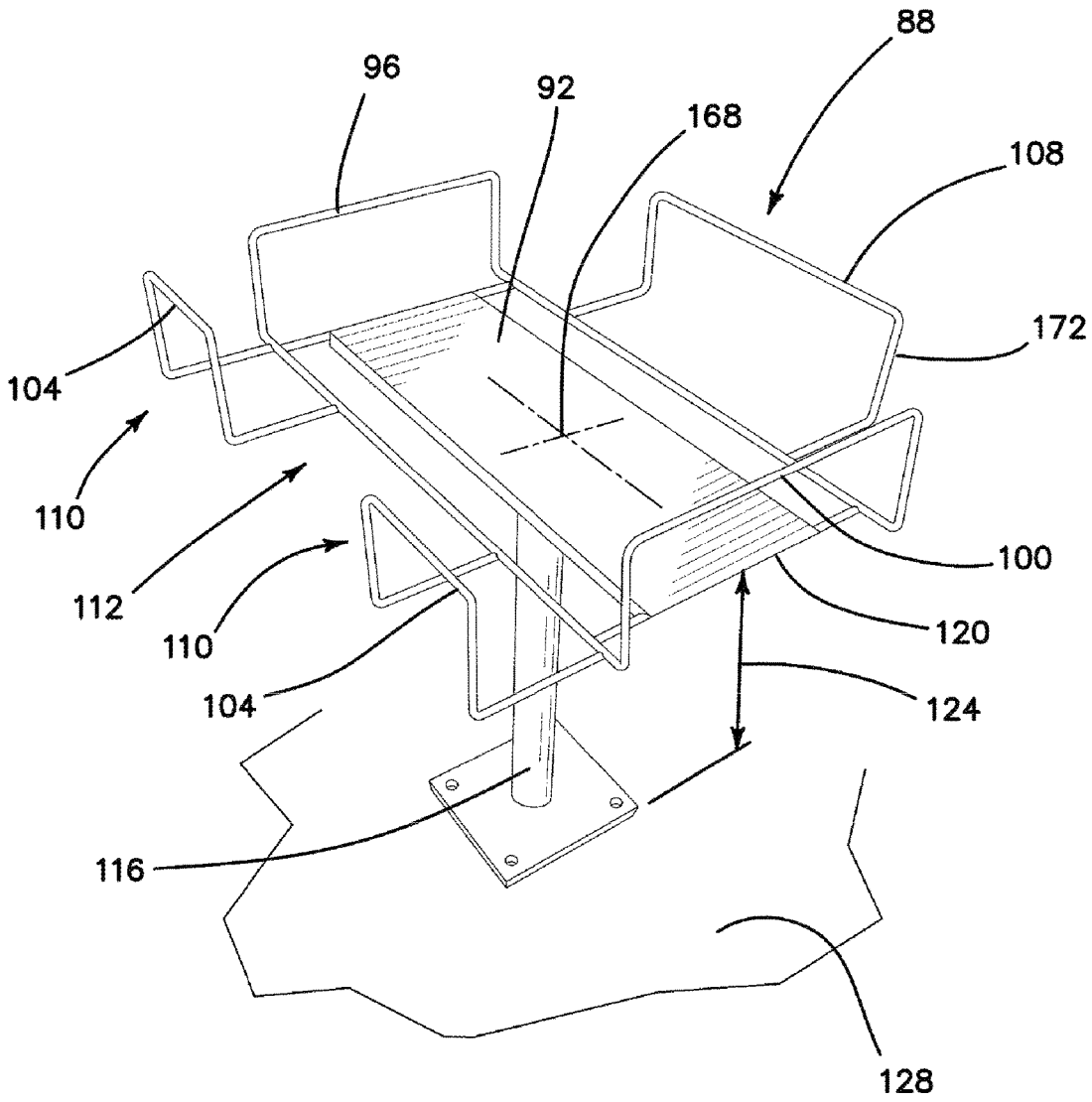
FIG. 2 is a perspective view of a dispenser rack for the FIG. 1 embodiment.

(8) In yet a further variant, as illustrated in FIG. 2, at least one of the first 96 and second 100 side guards and front 104 and rear 108 guards is angled 110 toward a center 168 of the platform 92, adapting the guard 96, 100, 104, 108 to frictionally grip the container 14.

(9) In another variant of the invention, the dispenser rack 88 is of wire form construction 172.

Figure 7:
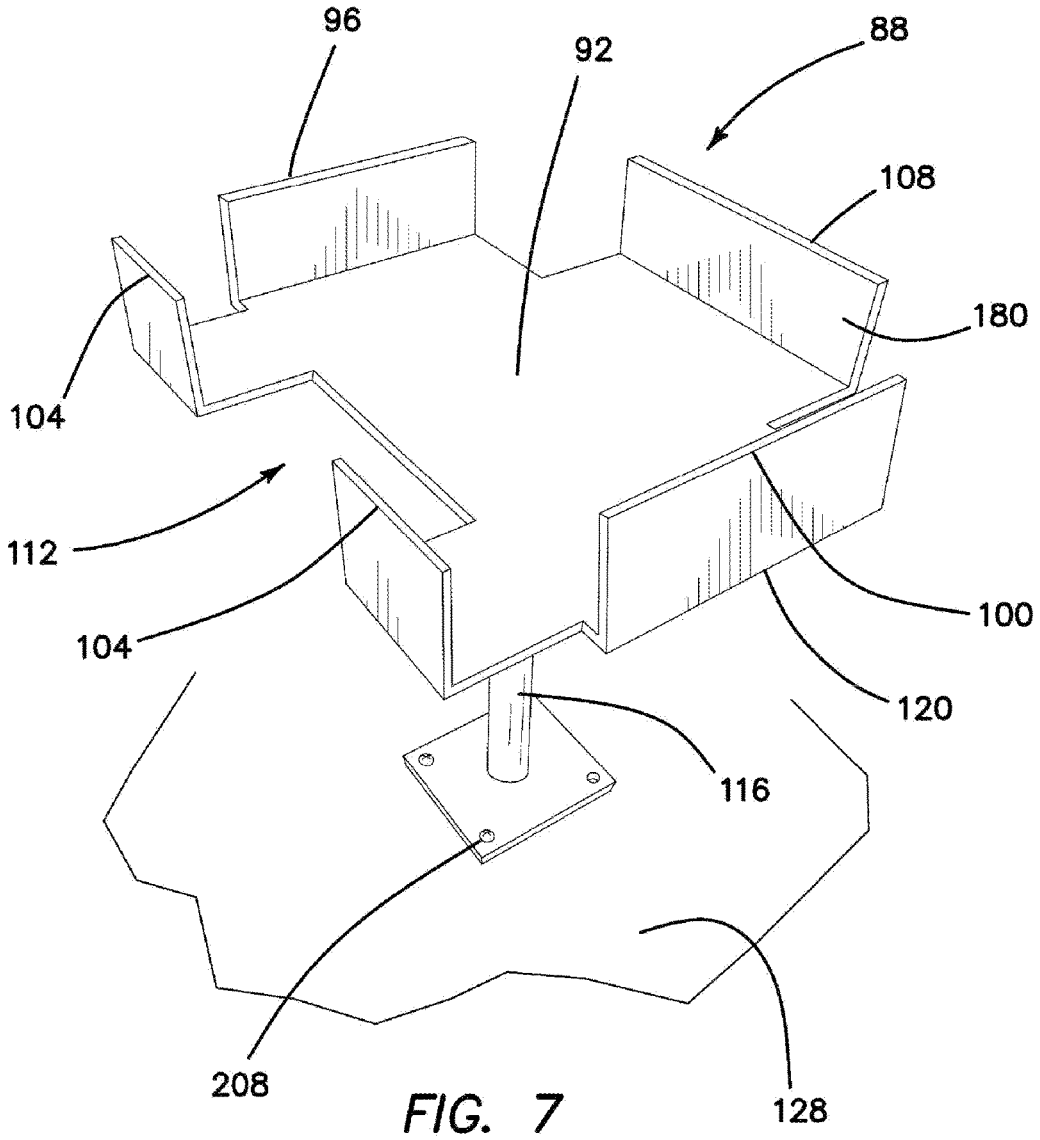
FIG. 7 is perspective view of the FIG. 2 embodiment dispenser rack formed of plastic material.
Figure 8:
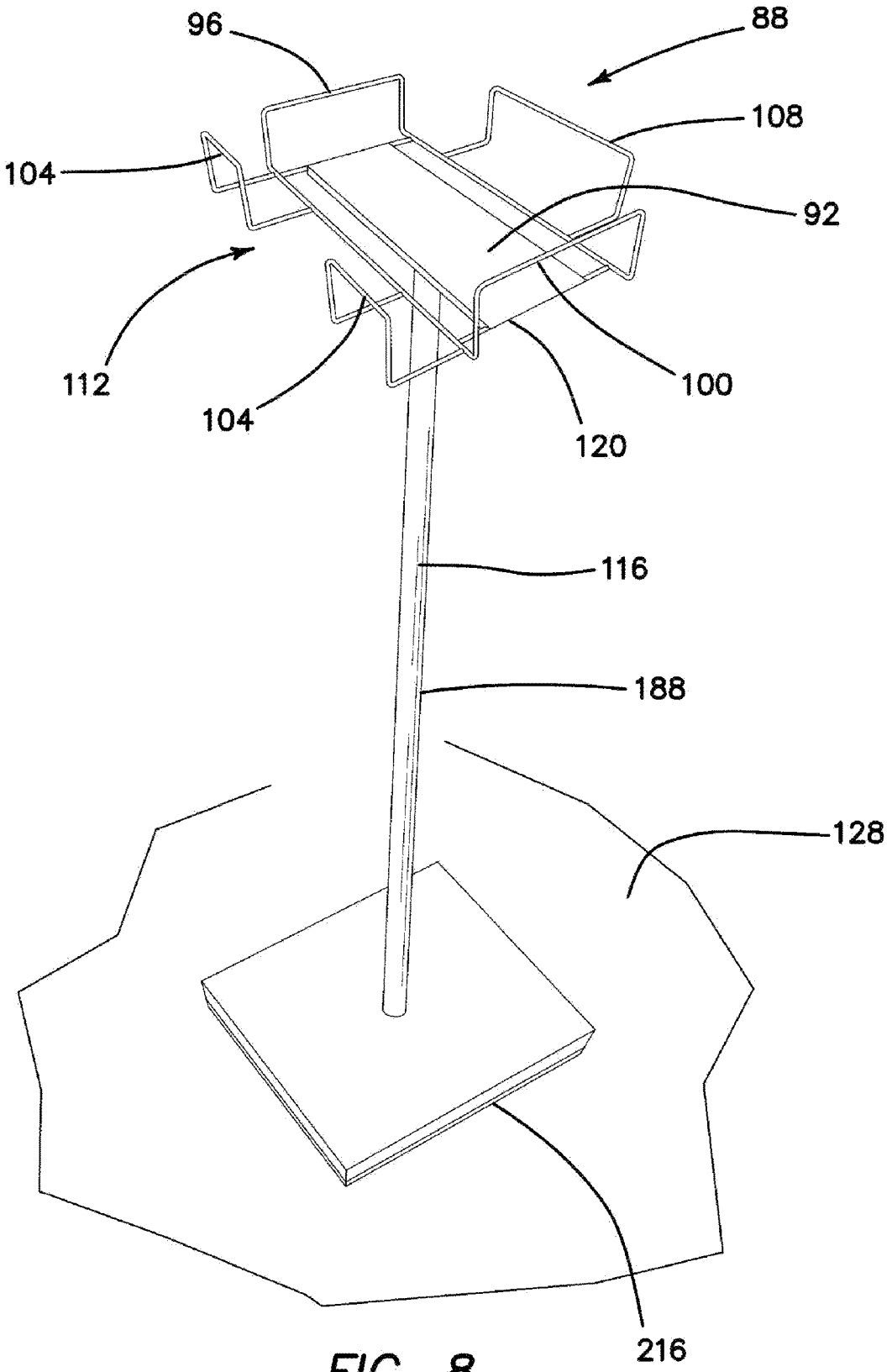
FIG. 8 is a perspective view of the FIG. 2 embodiment illustrating a floor stand variant with hooking and looping attachment to a surface.
Figure 9:
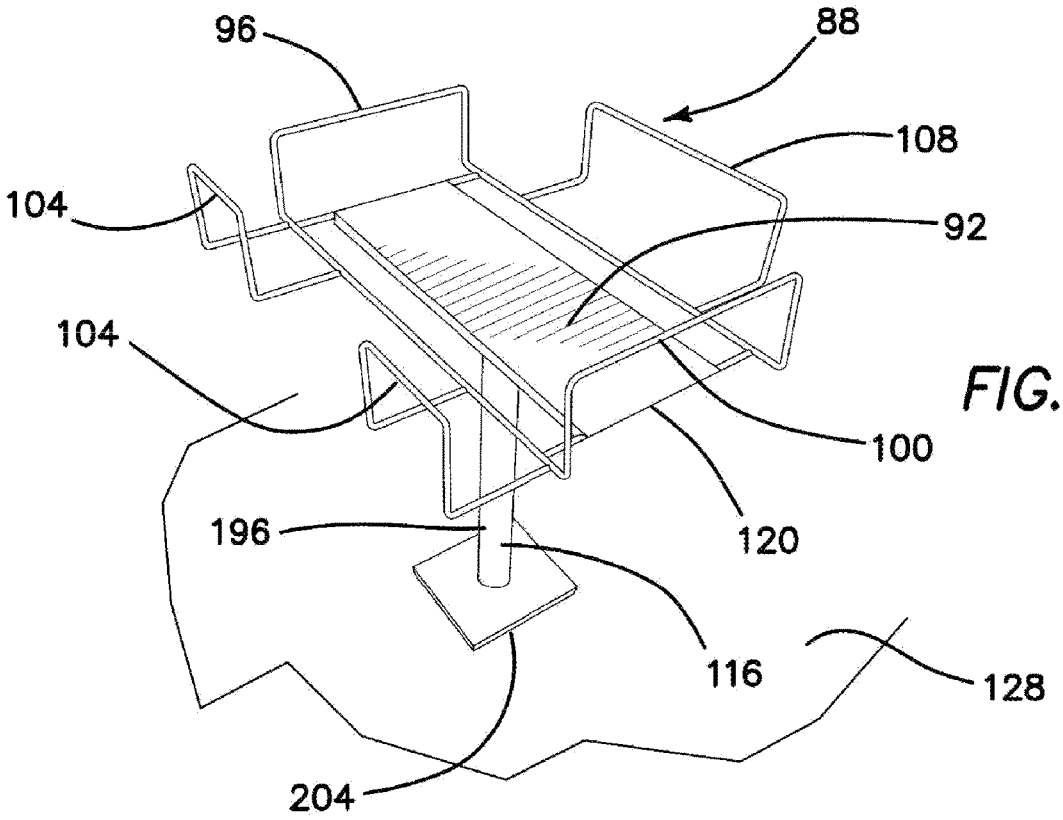
FIG. 9 is a perspective view of the FIG. 2 embodiment illustrating a surface mount variant with glue attachment to a surface.
Figure 10:
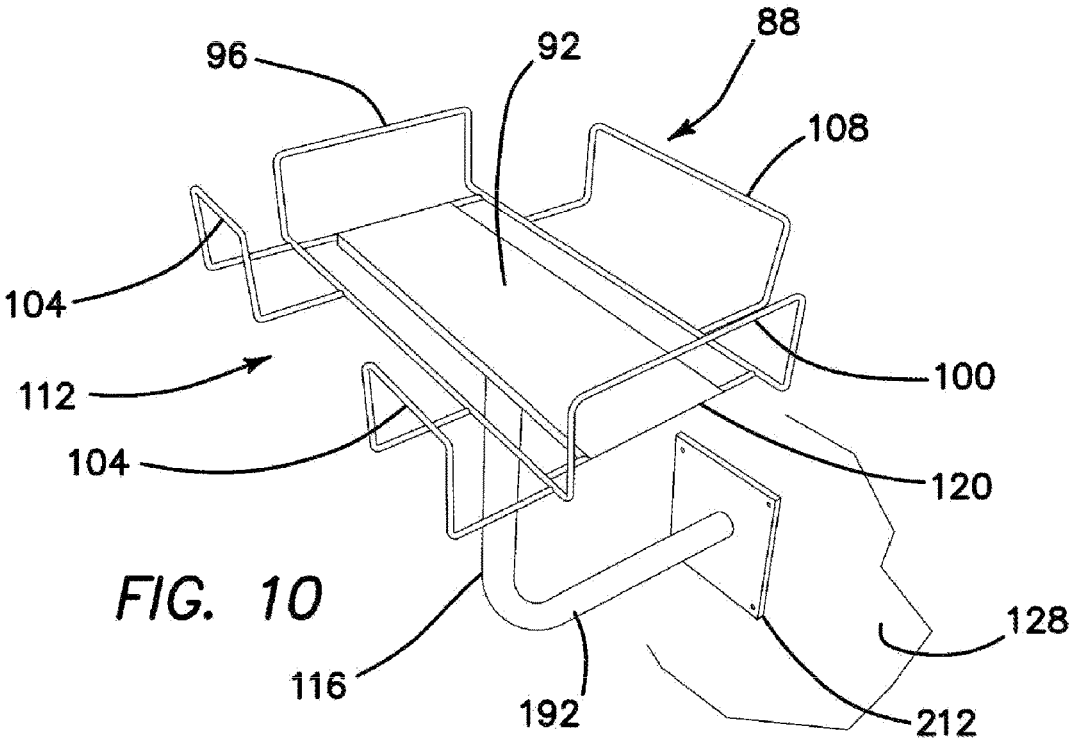
FIG. 10 is a perspective view of the FIG. 2 embodiment illustrating a wall mount variant with nail attachment to a surface.

(10) In still another variant, as illustrated in FIG. 7, the dispenser rack 88 is formed of wood (not shown), plastic 180 or metal (not shown).

(11) In yet another variant, as illustrated in FIGS. 2, 3, and 7-10, the rack support 116 is selected from the group that includes floor stands 188, wall mounts 192, surface mounts 196, counter mounts 200, glue 204, screws 208, nails 212, looping and hooking fasteners (Velcro®) 216.

Figure 11:
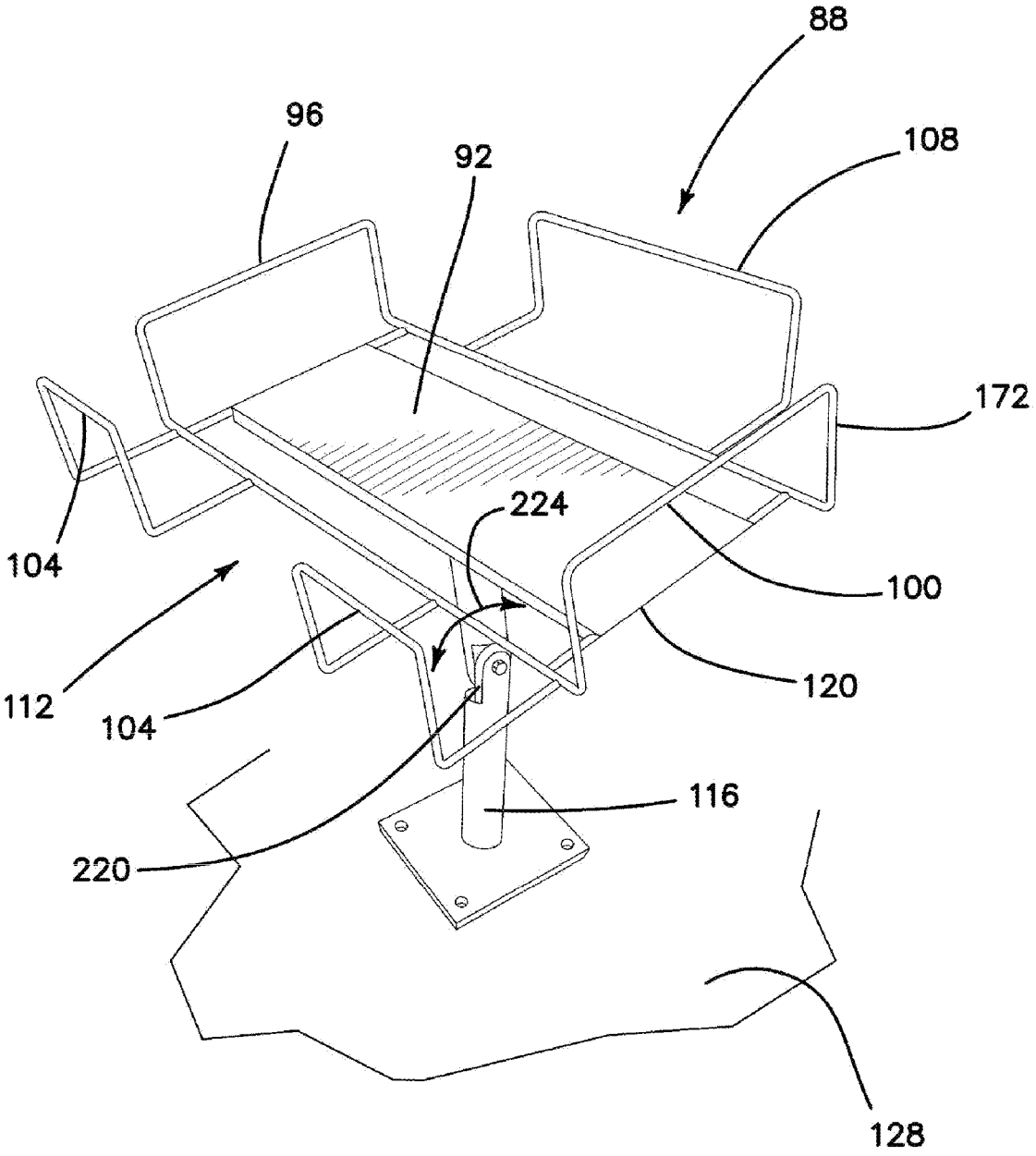
FIG. 11 is a perspective view of the FIG. 2 embodiment illustrating a tilting mount variant with screw attachment to a surface.
Figure 12:
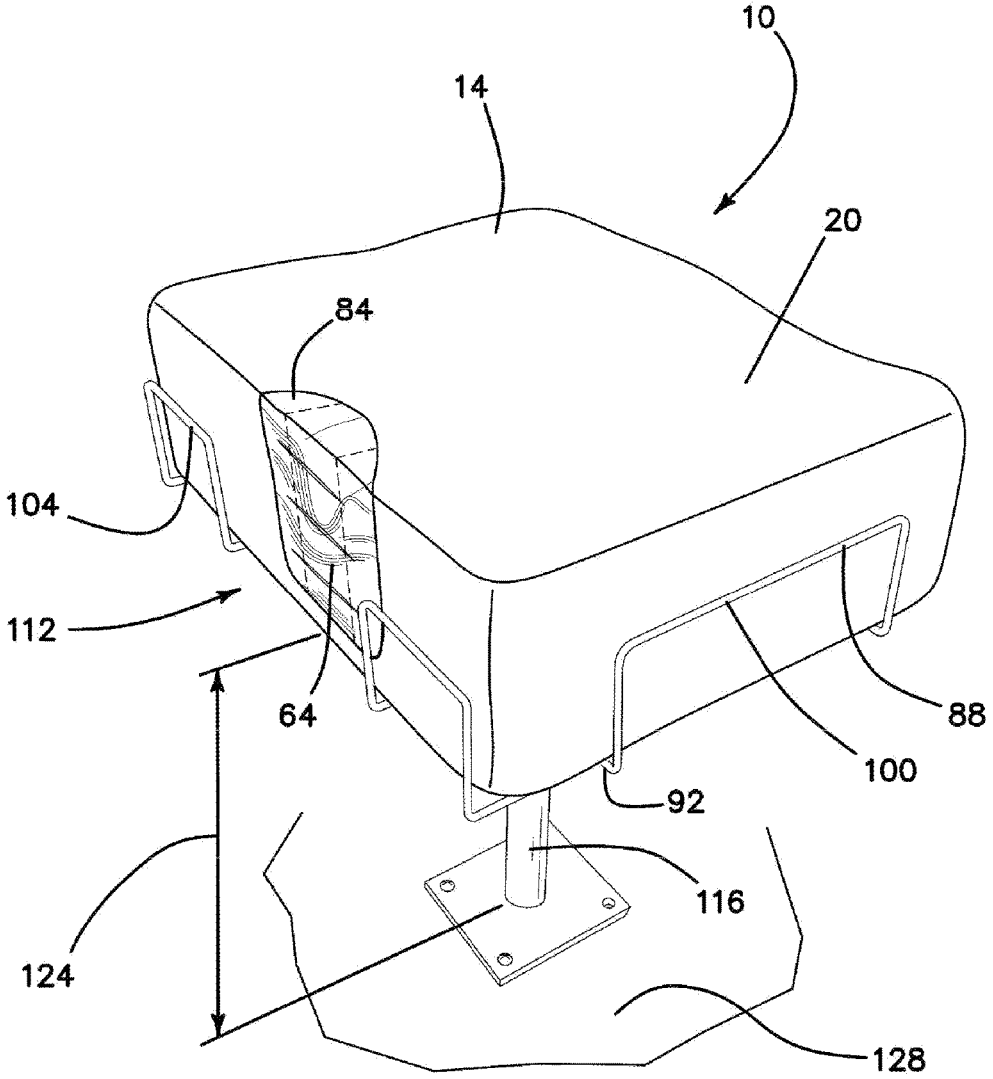
FIG. 12 is a perspective view of a bag container sleeve constructed of flexible material.

(12) In a further variant, as illustrated in FIG. 11, the rack support 116 includes a tilting mount 220. The tilting mount 220 is adapted to position the platform 92 at a variety of angles 224 for dispensing bags 64.

(13) In still a further variant, as illustrated in FIG. 1A, a flexible closure flap 228 is provided. The flap 228 is sized and shaped to removably close the opening 84 in the container 14. The opening 84 results from removal of the access panel 44. The flap 228 is attached along an upper edge 240 of the flap 228 and is affixed to the top 26 so as to hang over the opening 84, thereby protecting the container 14 from contamination.

(14) In yet a further variant, the flexible closure flap 228 is attached to the container 14 using an attachment mechanism 230 selected from the group comprising glue (not shown), adhesive coatings 236, tape 234, staples 238, tacks (not shown), and piercings (not shown).

Figure 1B:
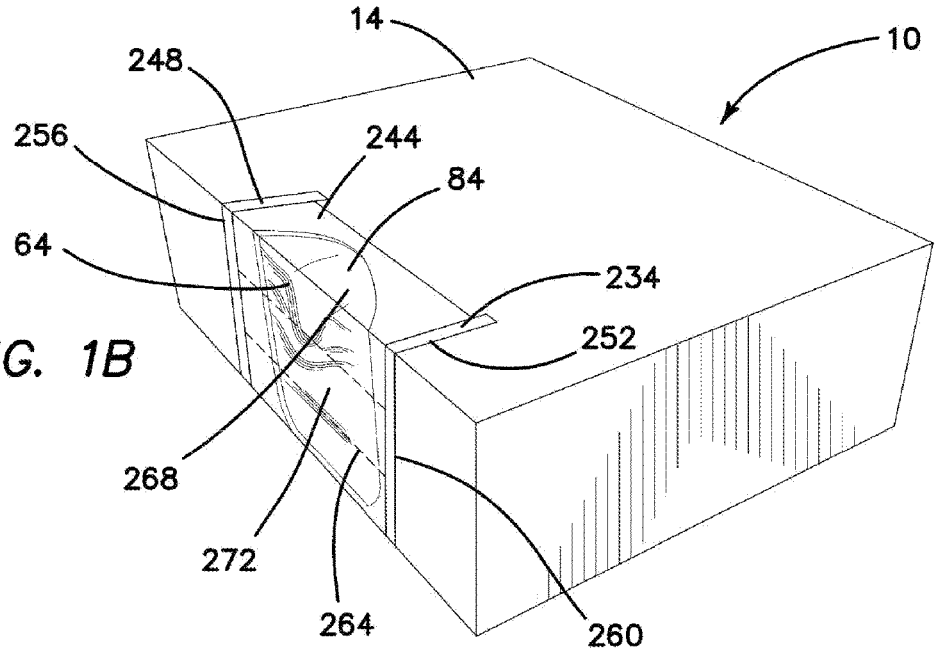
FIG. 1B is a perspective view of the FIG. 1 embodiment illustrating a flexible closure portion attached to the dispenser, illustrating multiple horizontal tear away strips.

(15) In another variant of the invention, as illustrated in FIG. 1B, a flexible closure portion 244 is provided. The portion 244 is sized and shaped to removably close the opening 84 in the container 14. The opening 84 results from removal of the access panel 44. The portion 244 is attached along first 248 and second 252 side edges of the portion 244. The portion 244 is affixed to sides 256, 260 of the opening 84. The portion 244 has at least one perforation 264 extending from the first side edge 248 to the second side edge 252. The perforation 264 permits partial removal of the portion 244 to permit access to a first stacked number 268 of the bags 64 while protecting a remainder 272 of the bags 64 from contamination.

(16) In still another variant, the flexible portion 244 is attached to the container 14 using an attachment mechanism 230 selected from the group comprising glue (not shown), adhesive coatings 236, tape 234, staples 238, tacks (not shown), and piercings (not shown).

Figure 1C:
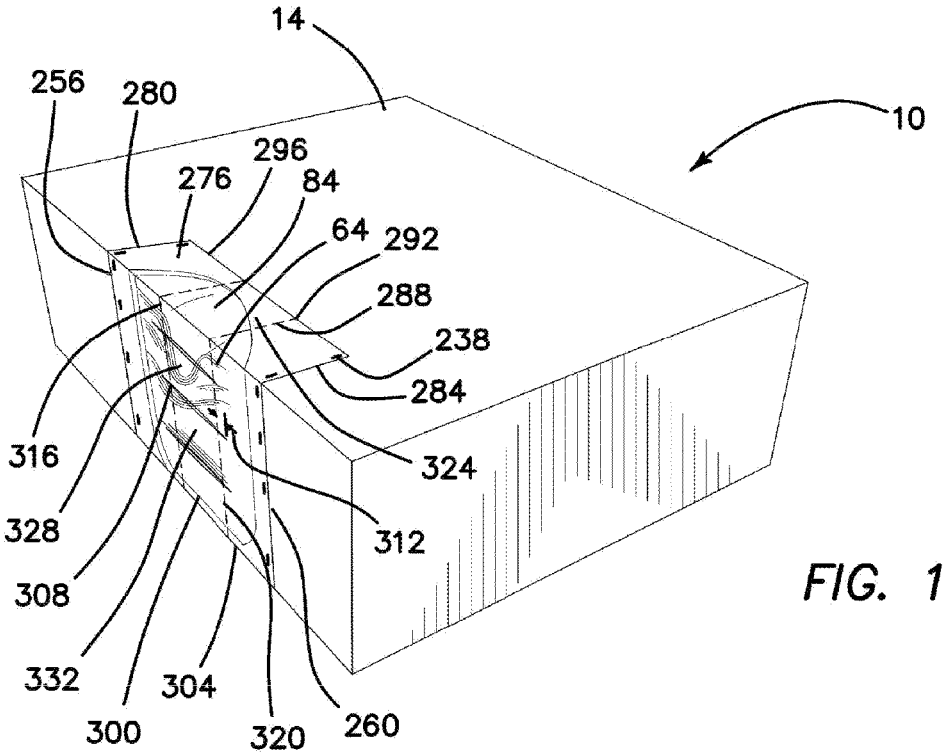
FIG. 1C is a perspective view of the FIG. 1 embodiment illustrating a flexible closure segment attached to the dispenser, illustrating a multi-segment vertical perforation.

(17) In yet another variant of the invention, as illustrated in FIG. 1C, a flexible closure segment 276 is provided. The segment 276 is sized and shaped to removably close the opening 84 in the container 14. The opening 84 results from removal of the access panel 44. The segment 276 is attached along first 280 and second 284 side edges of the segment 276 and is affixed to sides 256, 260 of the opening 84. The segment 276 has at least one perforation 288 extending from a point 292 adjacent a top edge 296 of the segment 276 to a point 300 adjacent a bottom edge 304 of the segment 276. The perforation 288 has at least one orthogonal cut 308. The cut 308 extends for a first pre-determined distance 312 on at least one side 316, 320 of the perforation 288. The cut 308 adapts the perforation 288 to be opened in stages 324, 328, 332, thereby minimizing contamination of bags 64 dispensed through the opening 84.

(18) In a further variant, the flexible segment 276 is attached to the container 14 using an attachment mechanism 230 selected from the group comprising glue (not shown), adhesive coatings 236, tape 234, staples 238, tacks (not shown), and piercings (not shown).

Figure 5A:
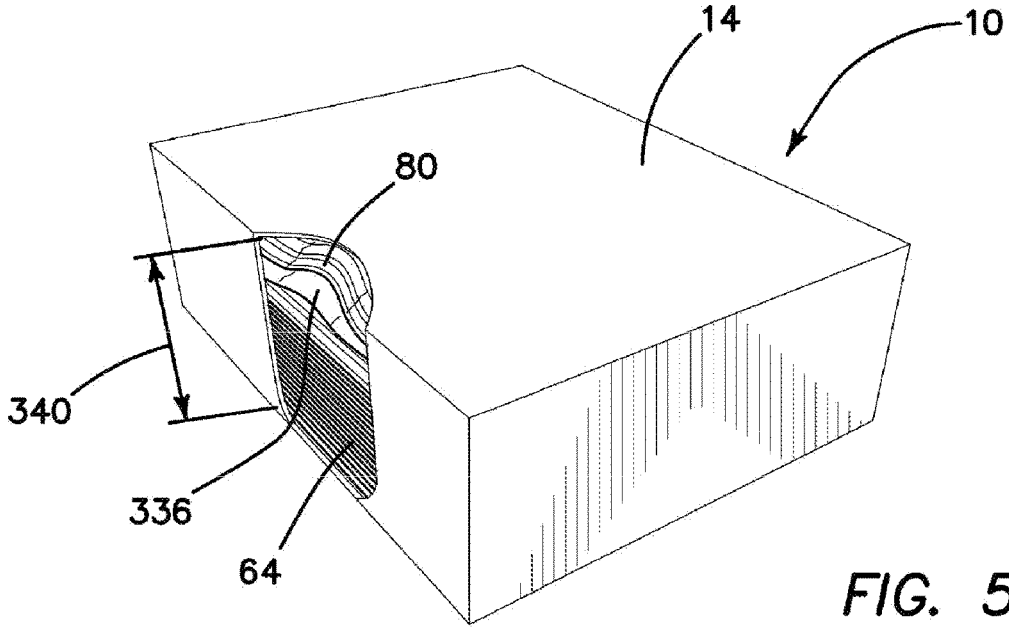
FIG. 5A is a perspective view of the FIG. 5 parallel track closure bags stacked in an alternating horizontal pattern in the container dispenser of the FIG. 1 embodiment.

(19) In still a further variant, as illustrated in FIG. 5A, the bags 64 are stacked with the closure mechanism 80 located in an alternating pattern 336 so as to minimize irregularity in a thickness 340 of the stacked bags 64.

Figure 6A:
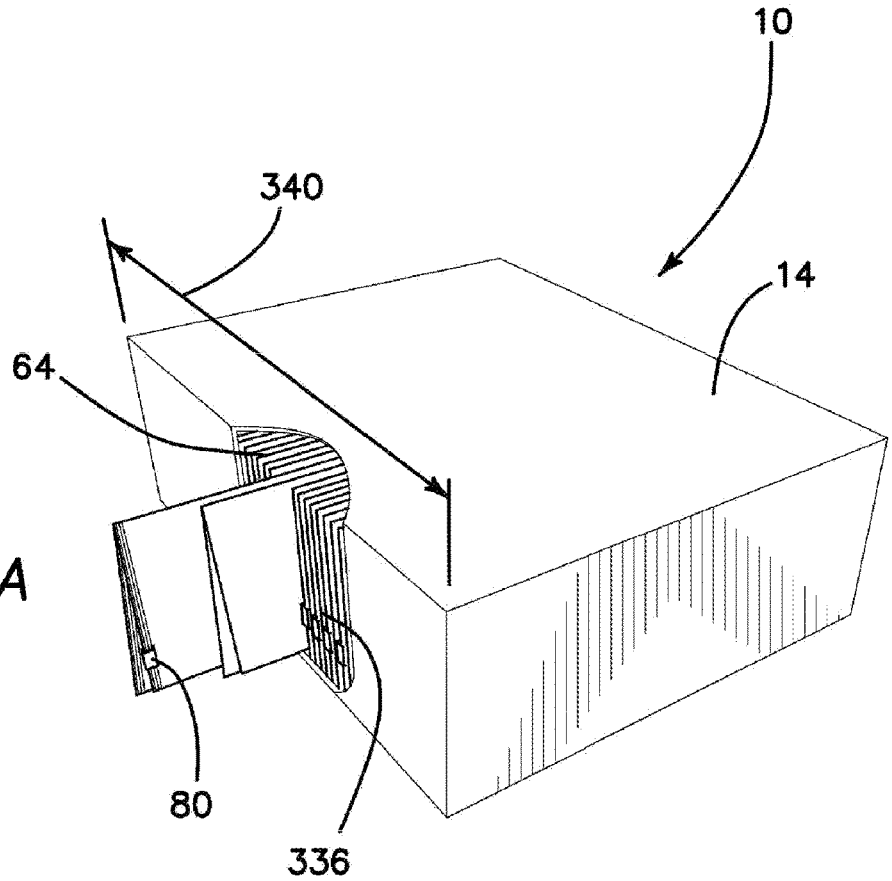
FIG. 6A is a perspective view of the FIG. 6 parallel track with sliding clip closure bags stacked in an alternating vertical pattern in the container dispenser of the FIG. 1 embodiment.

(20) In a final variant of the invention, as illustrated in FIG. 6A, the bags 64 are stacked with the closure mechanism 80 located in an alternating pattern 336 so as to minimize irregularity in a thickness 340 of the stacked bags 64.

The bag container dispenser 10 has been described with reference to particular embodiments. Other modifications and enhancements can be made without departing from the spirit and scope of the claims that follow.

The invention claimed is:

1. A bag container dispenser comprising:

a bag container, said container being formed of either of resilient or flexible material and having a bottom, a top, first and second sides, a front and a back;

said container having a removable access panel, said access panel comprising a top segment and a front segment, said top segment comprising a portion of said top and being connected to said front segment, said front segment having a height, said height extending from said bottom to said top;

a plurality of stacked bags, said bags being sized and shaped to fit within said bag container, each of said bags having a front wall, a back wall, an open top and a closure mechanism, said bags being dispensable from said container through an opening provided by removal of said access panel; and wherein, upon removal of said access panel from said container, said bags are dispensed singly from said container;

a dispenser rack, said rack having a horizontal platform, said platform being sized and shaped to support said bag container, first and second side guards and front and rear guards, said guards extending orthogonally upward from said platform and being adapted to constrain movement of said bag container, said front guard providing an open space adapted to align with said opening;

a rack support, said support attached to a lower surface of said horizontal platform and adapted to maintain said platform at a first pre-determined height and to provide attachment to a surface;

said first and second side guards and front and rear guards are angled toward a center of said platform, adapting said guards to frictionally grip said first and second sides and said front and back of said container; and ends of said first and second side guards being spaced from ends of said front and rear guards, respectively, to permit said first and second side guards and said front and rear guards to be angled toward said center of said platform.

2. The bag container dispenser, as described in claim 1, wherein said rack support comprises a tilting mount, said tilting mount adapted to position said platform at a variety of angles for dispensing bags.

3. The bag container dispenser, as described in claim 1, wherein said bag container is formed from material selected from the group comprising:

cardboard, paperboard, plastic, and metal foil.

4. The bag container dispenser, as described in claim 1, wherein said removable access panel is attached to said container with a perforation.

5. The bag container dispenser, as described in claim 1, wherein said plurality of stacked bags have a closure mechanism comprising a foldable top flap, said top flat adapted to close said bag.

6. The bag container dispenser, as described in claim 1, wherein said plurality of stacked bags have a closure mechanism comprising a pair of parallel tracks, said tracks adapted to be pressed together to close said bag.

7. The bag container dispenser, as described in claim 1, wherein said plurality of stacked bags have a closure mechanism comprising a pair of parallel tracks, said tracks adapted to be pressed together using a sliding clip, said clip being slidably secured to said tracks.

8. The bag container dispenser, as described in claim 6, wherein said bags are stacked with said closure mechanism disposed in an alternating pattern so as to minimize irregularity in a thickness of said stacked bags.

9. The bag container dispenser, as described in claim 1, wherein said dispenser rack is of wire form construction.

10. The bag container dispenser, as described in claim 1 wherein said dispenser rack is formed of wood, plastic or metal.

11. The bag container dispenser, as described in claim 1, wherein said rack support is selected from the group comprising:

floor stands, wall mounts, surface mounts, counter mounts, glue, screws, nails and looping and hooking fasteners (Velcro®).

12. The bag container dispenser, as described in claim 7, wherein said bags are stacked with said closure mechanism disposed in an alternating pattern so as to minimize irregularity in a thickness of said stacked bags.

* * * * *